US005850682A

United States Patent [19]

Ushiro

[11] Patent Number: 5,850,682

[45] Date of Patent: Dec. 22, 1998

[54] METHOD OF MANUFACTURING CHIP-TYPE COMMON MODE CHOKE COIL

[75] Inventor: Tomoaki Ushiro, Kyoto, Japan

[73] Assignee: Murata Manufacturing Co., Ltd., Kyoto-fu, Japan

[21] Appl. No.: 677,071

[22] Filed: Jul. 9, 1996

Related U.S. Application Data

[62] Division of Ser. No. 180,216, Jan. 12, 1994, Pat. No. 5,552,756.

[30] Foreign Application Priority Data

Jan. 13, 1993 [JP] Japan ..... Hei. 5-22148

[51] Int. Cl.[6] ..... H01F 41/02

[52] U.S. Cl. ..... 29/608; 29/602.1; 336/200; 336/233

[58] Field of Search ..... 29/602.1, 608, 29/606; 336/200, 233, 234

[56] References Cited

U.S. PATENT DOCUMENTS 5,386,206 1/1995 Iwatani et al. ..... 336/200
5,479,695 1/1996 Grader et al. ..... 29/602.1

*Primary Examiner*—Carl E. Hall
*Attorney, Agent, or Firm*—Ostrolenk, Faber, Gerb & Soffen, LLP

[57] ABSTRACT

In a chip type common mode choke coil, a plurality of non-magnetic sheets on which conductor lines are formed are laminated one on another to form a non-magnetic member, and the conductor lines are connected to form primary and secondary coils inside the non-magnetic member, and a pair of magnetic layers are formed on the upper and lower surface of the non-magnetic member, and magnetic cores are arranged substantially at the centers of the loops of the coils in such a manner that they penetrate the non-magnetic member and are connected to the pair of magnetic layers, whereby a closed magnetic path crossing the primary and secondary coils is formed.

20 Claims, 7 Drawing Sheets

METHOD OF MANUFACTURING CHIP-TYPE COMMON MODE CHOKE COIL

This is a division of application Ser. No. 08/180,216, filed Jan. 12, 1994, now U.S. Pat. No. 5,552,756.

BACKGROUND OF THE INVENTION

1. Field of the Invention

This invention relates to a common mode choke coil used for removing noise signals which are equal in phase which are transmitted from the power line, and more particularly to a chip type common mode choke coil which is small in size and can be mounted on the surface of a printed circuit board, and its manufacturing method.

2. Discussion of the Related Art

Recently, as electronic circuits are decreased in size, increased in the degree of integration, and increased in the frequency handled, there has been a strong demand for provision of a chip type common mode choke coil which is small in size and can be mounted on the surface of a printed circuit board.

An example of a conventional common mode choke coil is a wound common mode choke coil (not shown), which is formed by winding two conductors on a ring-shaped magnetic core or bar-shaped magnetic core the same number of turns in the same direction.

The conventional wound common mode chock coil is disadvantageous in the following points: Since it is formed by winding the conductors on the magnetic core as was described above, the manufacturing method is intricate, and therefore the choke oil is not suitable for mass production, and accordingly it is high in manufacturing cost. In the case where the magnetic core is increased in size to some extent, in order to hold it and to connect the windings and to mount the choke coil on the surface of a printed circuit board, it is necessary to provide a housing seat with electrodes. Hence, it is difficult to miniaturize the wound common mode choke coil sufficiently, and it is not suitable to mount it on an electrical circuit including a number of circuit elements.

SUMMARY OF THE INVENTION

Accordingly, an object of this invention is to eliminate the above-described difficulties accompanying a conventional common mode choke coil.

More specifically, an object of the invention is to provide a chip type common mode choke coil which is simple in structure, suitable for miniaturization, high in mass productivity, and high in economization, and which is able to provide high impedance and has a large coupling coefficient.

Another object of the invention is to provide a method of manufacturing the chip type common mode choke coil mentioned above.

The foregoing objects and other objects of the invention have been achieved by the provision of the following means:

The first means is a chip type common mode choke coil which, according to the invention, comprises:

a non-magnetic member formed by laminating a plurality of non-magnetic sheets on which conductor lines are formed;

the conductor lines being connected to form a primary coil and a secondary coil inside the non-magnetic member;

a pair of magnetic layers arranged on the upper and lower surfaces of the non-magnetic member, respectively; and magnetic cores arranged substantially at the centers of the loops of the coils in such a manner that the magnetic cores penetrate at least the non-magnetic member and are connected to the pair of magnetic layers arranged on the upper and lower surfaces of the non-magnetic member, thus forming a closed magnetic path which crosses the coils.

In the manufacture of the chip type common mode choke coil of the invention, a so-called "lamination method" is employed, and the manufacturing operation is simplified. Moreover, the primary and secondary coils are formed inside the non-magnetic member, which prevents the magnetic flux from spreading between the electrodes of the primary and secondary coils, and increases the coupling coefficient of the primary and secondary coils.

The closed magnetic path is formed through the magnetic layers which crosses the primary and secondary coils, and therefore the common impedance is high.

The second means is a multiple chip type common mode choke coil in which a plurality of common mode choke coil elements equal in structure to the above-described chip type common mode choke coil are arranged in one non-magnetic member, a pair of magnetic layers are arranged on the upper and lower surfaces of the non-magnetic member, and magnetic cores are arranged substantially at the centers of the loops of the coils in such a manner that the magnetic cores penetrate at least the non-magnetic member and are connected to the magnetic layers; in which, according to the invention, at least one of the pair of magnetic layers is divided into parts in correspondence to the common mode choke elements.

In the multiple chip type common mode choke coil formed by arranging a plurality of common mode choke coil elements, the magnetic layer formed on the surface is divided, for instance, with grooves into parts in correspondence to the common mode choke coil elements. Hence, in each of the common mode choke coil elements, a closed magnetic circuit is formed, which prevents cross talk between adjacent common mode choke coil elements.

The third means is a method of manufacturing the chip type common mode choke coil in which, according to the invention, core arranging holes in which magnetic cores are to be arranged are formed in a laminate, which comprises the non-magnetic member inside of which the coils have been formed, and the pair of magnetic layers formed on the upper and lower surfaces of the non-magnetic member, substantially at the centers of the loops of the coils, and a magnetic paste is rubbed in the core arranging holes, so that magnetic cores are formed substantially at the centers of the loops of the coils.

In the method, the core arranging holes are formed in the laminate substantially at the centers of the loops of the coils which are formed in a predetermined pattern inside the non-magnetic member, and the magnetic paste is rubbed in the core arranging holes. Hence, the magnetic cores are positioned substantially at the centers of the loops of the coils.

The fourth means is another method of manufacturing the chip type common mode choke coil in which, according to the invention, a magnetic member having a predetermined thickness is placed on a laminate, which comprises the non-magnetic member inside of which the coils have been formed, and the pair of magnetic layers formed on the upper and lower surface of the non-magnetic member, to prepare an assembly of the laminate and the magnetic member, and the assembly is punched with a puncher operating with a predetermined stroke, so that, substantially at the centers of the loops of the coils, core arranging holes are formed in the laminate while magnetic member pieces are blanked from the magnetic member and are press-fitted in the core arranging holes.

In the method, the magnetic member having the predetermined thickness is placed on the laminate to provide the assembly of the laminate and the magnetic member, and the assembly is punched with the puncher which operates with a predetermined stroke, so that, substantially at the centers of the loops of the coils, the core arranging holes are formed in the laminate while the magnetic pieces are punched from the magnetic member and press-fitted in the core arranging holes. Hence, in this case, too, the magnetic cores can be arranged substantially at the centers of the loops of the coils.

The nature, utility and principle of the invention will be more clearly understood from the following detailed description and the appended claims when read in conjunction with the accompanying drawings.

DETAILED DESCRIPTION OF THE INVENTION

Preferred embodiments of the invention together with methods of manufacturing them will be described with reference to the accompanying drawings.

(First Embodiment)

An example of a chip type common mode choke coil, which constitutes a first embodiment of the invention, will be described with reference to FIGS. 1 through 4.

Figure 1:
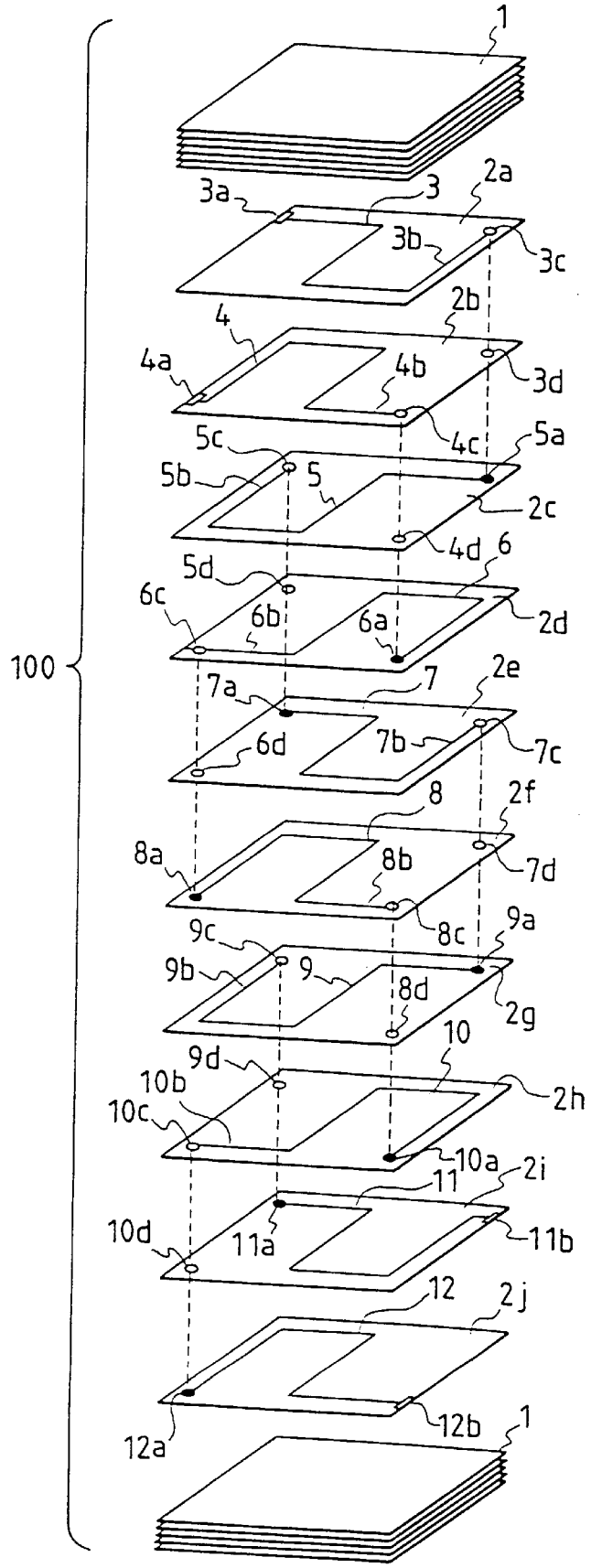
FIG. 1 is an exploded perspective view showing a laminate in an example of a chip type common mode choke coil, which constitutes a first embodiment of this invention.

In those figures, reference numeral 100 designates a laminate used to form the chip type common mode choke coil. The laminate 100 is fabricated as follows: As shown in FIG. 1, first, non-magnetic sheets 2*a* through 2*j* are laminated on top of each other to form a non-magnetic sheet assembly, namely, a non-magnetic member 14 (described later), and a plurality of magnetic sheets 1 (forming a magnetic layer 13 described later) are stacked on the top of non-magnetic sheet assembly, and another plurality of magnetic sheets 1 (forming another magnetic layer 13 described later) are stacked on the bottom. Conductor lines 3 through 12 are formed on the non-magnetic sheets 2*a* through 2*j*, respectively.

More specifically, the conductor line 3 is provided for formation of a primary coil, and it is printed on the non-magnetic sheet 2*a* located immediately below the upper group of magnetic sheets 1. One end 3*b* of the conductor line 3 is connected through a through-hole 3*c* formed in the non-magnetic sheet 2*a* and a through-hole 3*c* formed in the non-magnetic sheet 2*b* (immediately below the non-magnetic sheet 2*a*) to one end 5*a* of the conductor line 5 on the non-magnetic sheet 2*c* located immediately below the non-magnetic sheet 2*b*; and the other end of the conductor line 5 is connected through a through-hole 5*c* formed in the non-magnetic sheet 2*c* and through a through-hole 5*d* formed in the non-magnetic sheet 2*d* immediately below the non-magnetic sheet 2*c* to one end 7*a* of the conductor line 7 formed on the non-magnetic sheet 2*e*; and so forth. As a result, the conductor lines 3, 5, 7, 9 and 11 on the non-magnetic sheets 2*a*, 2*c*, 2*e*, 2*g* and 2*i* are connected through the through-holes 3*c*, 3*d*, 5*c*, 5*d*, 7*c*, 7*d*, 9*c* and 9*d* to one another, thus forming a substantially figure-eight-shaped primary coil. The end 3*a* of the conductor 3 on the non-magnetic sheet 2*a*, and the end 11*b* of the conductor 11 on the non-magnetic sheet 2*i* are extended, as lead-out electrodes, over the end faces of the laminate 100.

Similarly, the conductor lines 4, 6, 8, 10 and 12 on the non-magnetic sheets 2*b*, 2*d*, 2*f*, 2*h* and 2*j* are connected through the through-holes 4*c*, 4*d*, 6*c*, 6*d*, 8*c*, 8*d*, 10*c* and 10*d* to one another, thus forming a substantially figure-eight-shaped secondary coil. The end 4*a* of the conductor line 4 on the non-magnetic sheet 2*b*, and the end 12*b* of the conductor line 12 on the non-magnetic sheet 2*j* are extended, as lead-out electrodes, over the end faces of the laminate 100.

The non-magnetic sheets 2*a* through 2*j* and the magnetic sheets 1 and 1 thus stacked are joined together under pressure. As a result, as shown in FIG. 2(*a*), the aforementioned laminate 100 is formed which comprises: a non-magnetic member 14 which is made up of the non-magnetic sheets; and magnetic layers 13 and 13 which are made up of the magnetic sheets and set on opposite sides of the non-magnetic member 14.

Figure 2A:
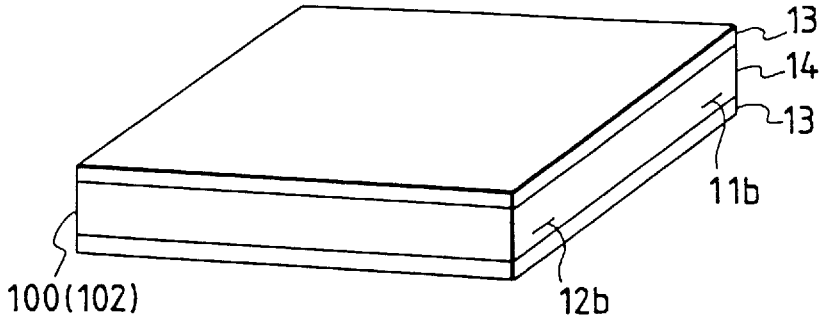
FIGS. 2(*a*)–2(*c*) show steps of manufacturing of the chip type common mode choke coil of the first embodiment—more specifically, FIG. 2(*a*) is a perspective view of the laminate, FIG. 2(*b*) is a perspective view of the laminate in which core arranging holes are formed, and FIG. 2(*c*) is also a perspective view of the laminate with the holes filled with magnetic paste.
Figure 2B:
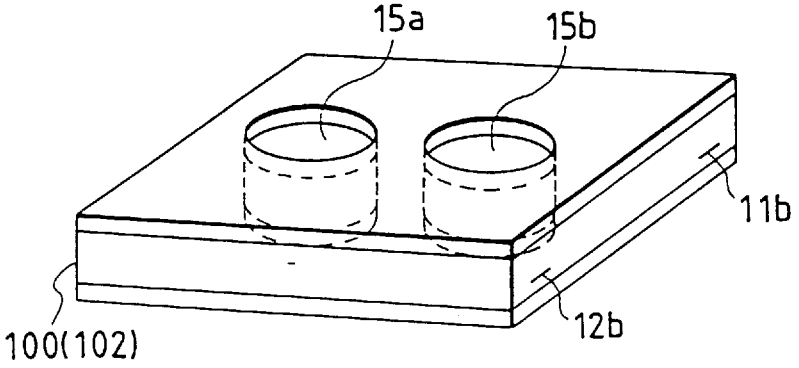
Figure 2C:
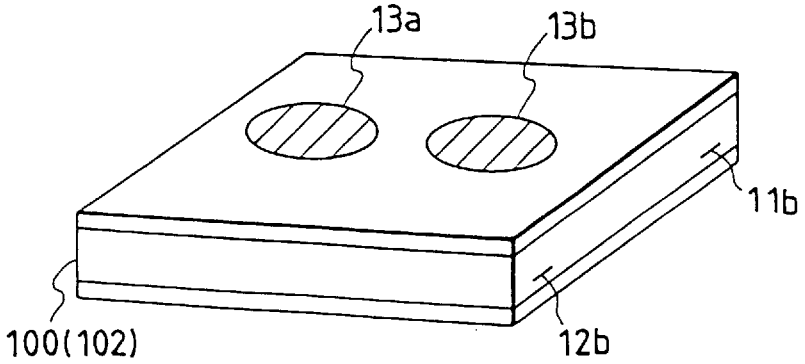

Under this condition, as shown in FIG. 2(*b*), holes (core arranging holes) 15*a* and 15*b* are formed in the laminate substantially at the centers of the loops of the substantially figure-eight-shaped primary and secondary coils; in other words, the primary and secondary coils are wound, substantially in the form of the figure "8", around the holes 15*a* and 15*b*.

Figure 3:
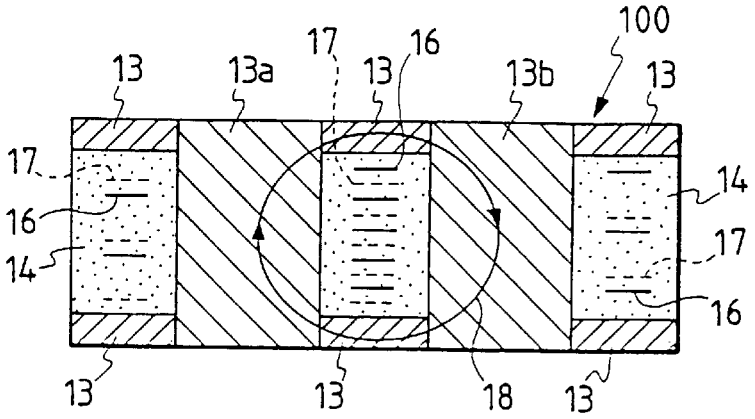
FIG. 3 is a sectional view of the laminate in the chip type common mode choke coil according to the first embodiment of the invention.

Thereafter, the holes 15*a* and 15*b* are filled with magnetic paste as indicated at 13*a* and 13*b* in FIG. 2(*c*). FIG. 3 is a sectional view showing the internal structure of the laminate 100 with the holes 15*a* and 15*b* filled with the magnetic pastes 13*a* and 13*b*. In FIG. 3, the primary coil 16 is indicated by the solid lines, and the secondary coil 17 by the dotted lines.

Magnetic cores can be readily positioned in the laminate substantially at the centers of the loops of the coils according to the following methods: substantially circular portions of the substantially figure-eight-shaped coils in the laminate. This operation can be achieved readily by employing the following methods:

(First Method)

Figure 5:
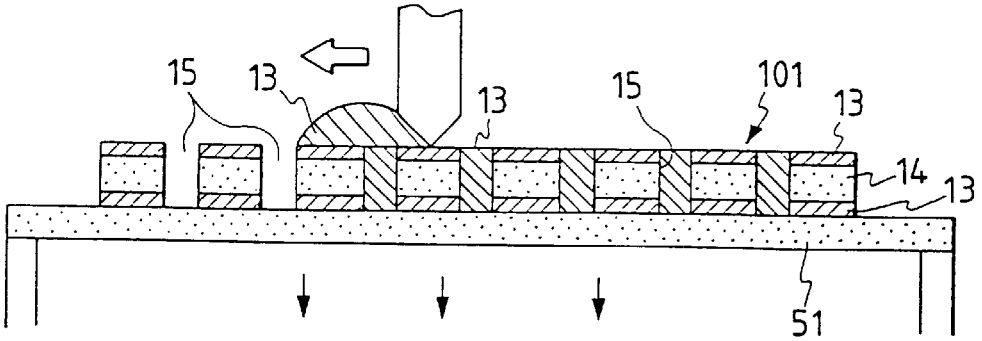
FIG. 5 is a sectional view for a description of a method of manufacturing the chip type common mode choke coil according to the first embodiment of the invention.
Figure 6A:
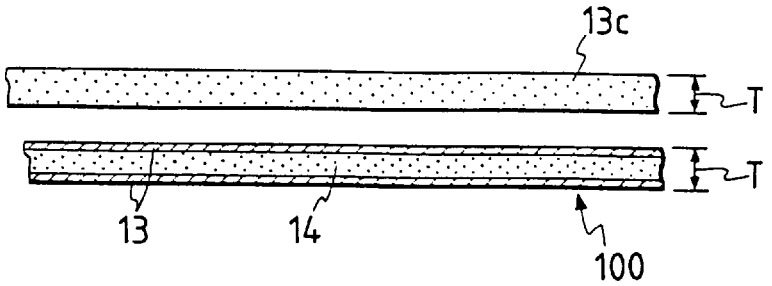
FIGS. 6(*a*)–6(*d*) are sectional views for a description of another method of manufacturing the chip type common mode choke coil according to the first embodiment of the invention—more specifically, FIG. 6(*a*) shows a magnetic member placed on the laminate, FIG. 6(*b*) shows punches abutted against the assembly of the magnetic member and the laminate, FIG. 6(*c*) shows the assembly which has been punched, and FIG. 6(*d*) shows the laminate in which a magnetic core has been press-fitted.
Figure 6B:
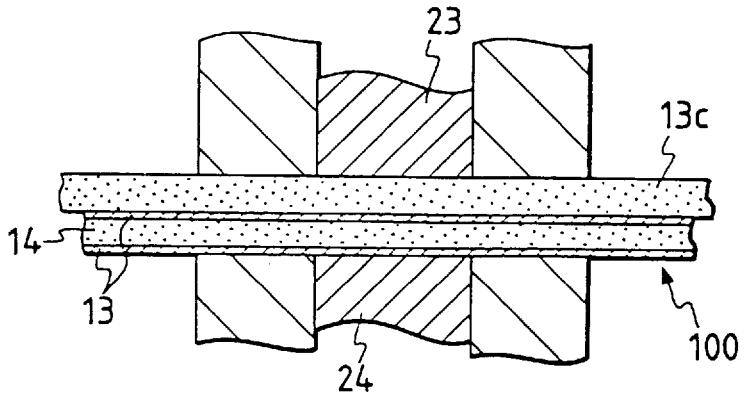
Figure 6C:
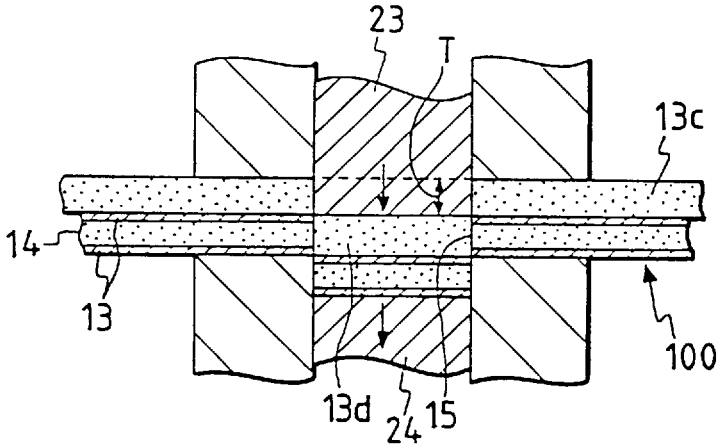
Figure 6D:
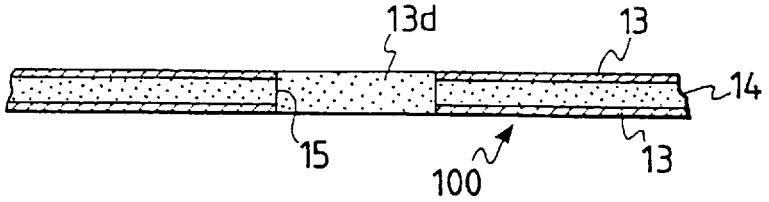

As shown in FIG. 5, a laminate (green block) having a number of holes (care arranging holes) 15 is set on a porous stand 51 to which suction is applied, and a magnetic paste 13 is rubbed in the holes of the laminate 100 from above according to the squeegee method, while suction is applied to the laminated 100, until the holes 15 are filled with it. Thereafter, the magnetic paste 13 is dried. It goes without saying that the magnetic paste 13 may be rubbed in the holes according to other methods.

In the method, by suitably adjusting the density of magnetic substance in the magnetic paste 13, the viscosity of the paste 13, and the force of suction, the holes 15 can be fully filled with the magnetic paste (magnetic core) 13.

(Second Method)

As shown in FIG. 6(*a*), first, a laminate (green pressure-attached member) 100 having a thickness T as shown in FIG. 2(*a*) is prepared, and a magnetic member (magnetic green body) 13*c* having the same thickness T is set on the laminate 100. Thereafter, a puncher is used. That is, as shown in FIG. 6(*b*), a punch 23 is set on the upper surface the assembly of the laminate 100 and the magnetic member 13*c*, and a punch 24 is set on the lower surface. Under this condition, the punches 23 and 24 are moved as much as the thickness T of the laminate 100 as shown in FIG. 6(*c*). As a result, as shown in FIG. 6(*d*), a hole 15 is formed in the laminate 100, while a magnetic piece (magnetic core) 13*d* is blanked from the magnetic member 13*c* and press-fitted in the hole 15 thus formed.

In the method shown in FIGS. 6(*a*)–6(*d*), one magnetic piece (magnetic core) is set in one hole 15. However, according to the method, it is possible to set a plurality of magnetic cores at a plurality of positions (or in a plurality of holes) with one action.

Figure 4:
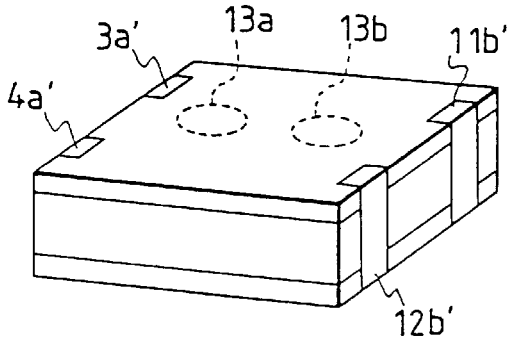
FIG. 4 is a perspective view of the chip type common mode choke coil according to the first embodiment of the invention.

Thereafter, the laminate 100 with the core arranging holes filled with the magnetic pastes 13*a* and 13*b* is fired, and the primary coil's external electrodes 3*a*' and 11*b*', and the secondary coil's external electrodes 4*a*' and 12*b*' are then connected. Thus, the chip type common mode choke coil has been formed as shown in FIG. 4.

In the chip type common mode choke coil according to the first embodiment, as shown in FIG. 3 the primary coil 16 and the secondary coil 17 are buried completely in the non-magnetic member 14. Therefore, substantially no magnetic flux spreads between the loops of the primary and second coils, and magnetic flux crossing the primary coil 16 and the secondary coil 17 forms a closed magnetic path as indicated at 18 in FIG. 3. Hence, the resultant chip type common mode choke coil is large in the coupling coefficient of the primary coil 16 and the secondary coil 17, and high in impedance.

(Second Embodiment)

Figure 7:
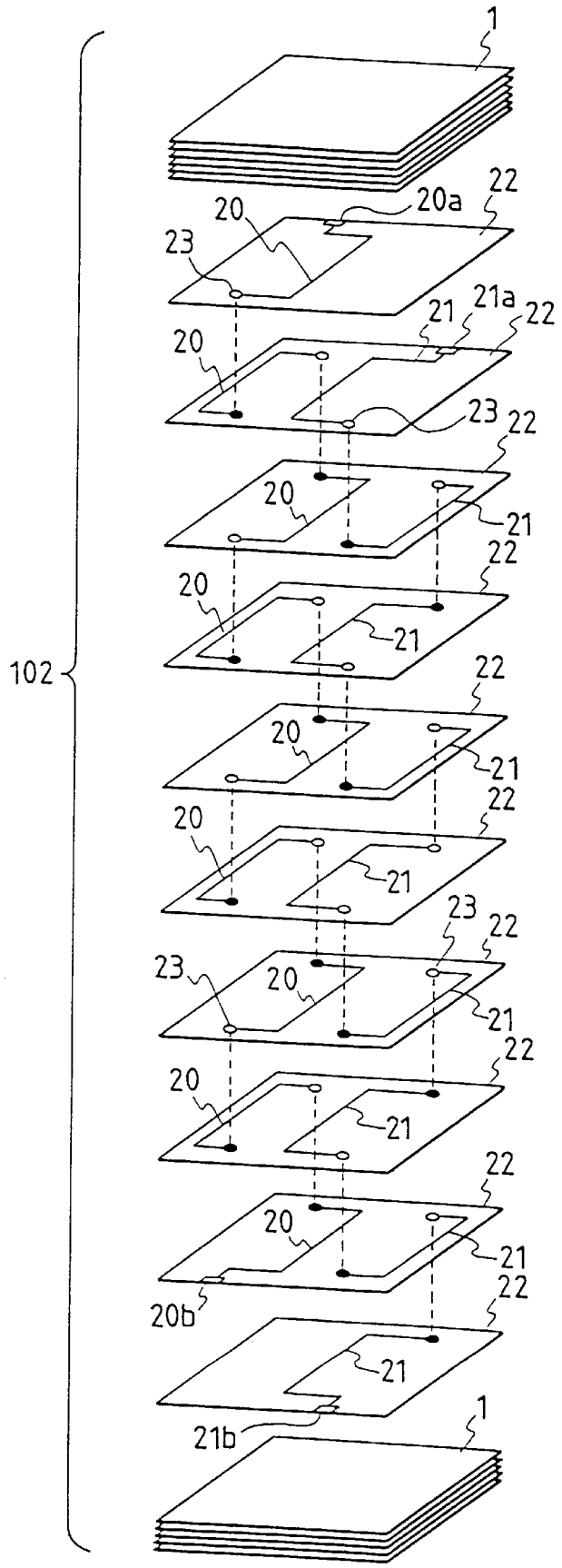
FIG. 7 is an exploded perspective view showing a laminate which is used to form another example of the chip type common mode choke coil, which constitutes a second embodiment of the invention.

Another example of the chip type common mode choke coil, which constitutes a second embodiment of the invention, will be described with reference to FIGS. 7 through 9.

In those figures, reference numeral 102 designates a laminate forming the chip type common mode choke coil (FIG. 9) according to the second embodiment. The laminate 102 is formed as shown in FIG. 7. That is, non-magnetic sheets 22 are laminated one on another to form an assembly of non-magnetic sheets, namely, a non-magnetic member 14 (described later) and a plurality of magnetic sheets 11 are stacked on the top of the assembly of non-magnetic sheets 22, to form a magnetic layer 13 (described later), while another plurality of magnetic sheets 11 are stacked on the bottom, to form another magnetic layer 13 (described later). Conductor lines 20 and 21 are formed on each of the non-magnetic sheets 22 at predetermined positions, and their pattern is different from that in the above-described first embodiment. That is, the conductor lines 20 and 21 are substantially U-shaped, and in each of the non-magnetic sheets 22, the conductor line 20 is laid in a half of the area (or in the left half area in FIG. 7), and the conductor line 21 is laid in the other half of the area (or in the right half area in FIG. 7). The conductor lines 20 are connected through through-holes 23 to one another to form the primary coil, and similarly the conductor lines 21 are connected through-holes 23 to one another to form the secondary coil.

The chip type common mode choke coil is formed by using the non-magnetic sheets 22 as follows:

First, the non-magnetic sheets 22 and the magnetic sheets 1 are laminated one on another and joined together under pressure, So form the laminate (green pressure-attached member) 102 which, as shown in FIG. 2(*a*), comprises a non-magnetic member 14 and a pair of magnetic layers 13 and 13 which are set on the upper and lower surfaces of the former 14, respectively.

Next, as shown in FIG. 2(*b*), a hole (core arranging hole) 15*a* is formed in the laminate 102 substantially at the center of the loop of the primary coil, and similarly another hole (core arranging hole) 15*b* is formed in the laminate 102 substantially at the center of the loop of the secondary coil.

Thereafter, the holes 15*a* and 15*b* are filled with magnetic paste as indicated at 13*a* and 13*b* to provide magnetic cores. FIG. 8 is a sectional view showing the internal structure of the laminate 102 with the holes 15*a* and 15*b* filled with the magnetic paste (13*a* and 13*b*). In FIG. 8, the primary coil 20 is indicated by the solid lines, and the secondary coil 21, by the dotted lines.

The laminate 102 (FIG. 8) is fired, and then the primary coil's external electrodes 20*a*' and 20*b*', and secondary the coil's external electrodes 21*a*' and 21*b*' are connected. Thus, the chip type common mode choke coil has been formed as shown in FIG. 9.

Figure 8:
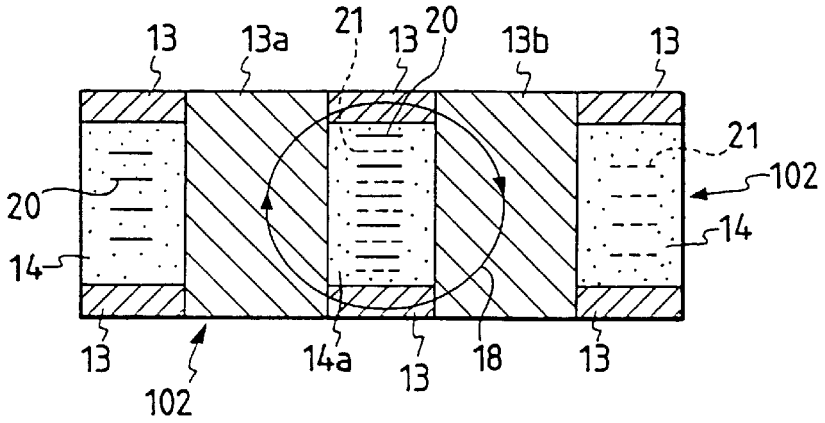
FIG. 8 is a sectional view of the laminate in the chip type common mode choke coil according to the second embodiment of the invention.
Figure 9:
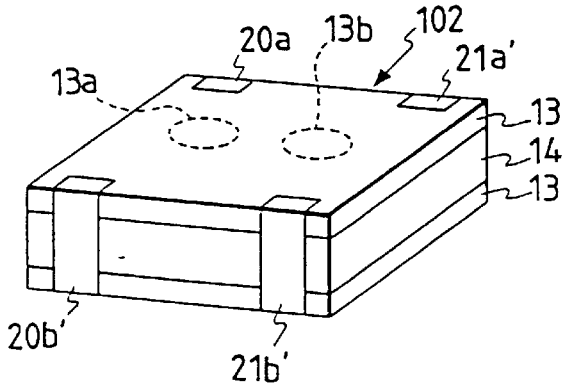
FIG. 9 is a perspective view of the chip type common mode choke coil according to the second embodiment of the invention.

In the chip type common mode choke coil according to the second embodiment, as shown in FIG. 8, the primary coil 20 is laid around the magnetic core 13*a* while the secondary coil 21 is laid around the magnetic core 13*b*, and in the middle portion 14*a* of the non-magnetic member 14 the conductor lines of the primary coil 20 and those of the secondary coil 21 are laid alternately one on another. Furthermore, the magnetic layers 13 and 13, and the magnetic cores 13*a* and 13*b* form a closed magnetic path around the middle portion 14*a* of the non-magnetic member 14, which provide a large magnetic flux output which completely crosses the primary coil 20 and the secondary coil 21. Hence, in the choke coil, the impedance is high, and the coupling coefficient of the primary coil 20 and the secondary coil 21 is large.

(Third Embodiment)

Figure 10:
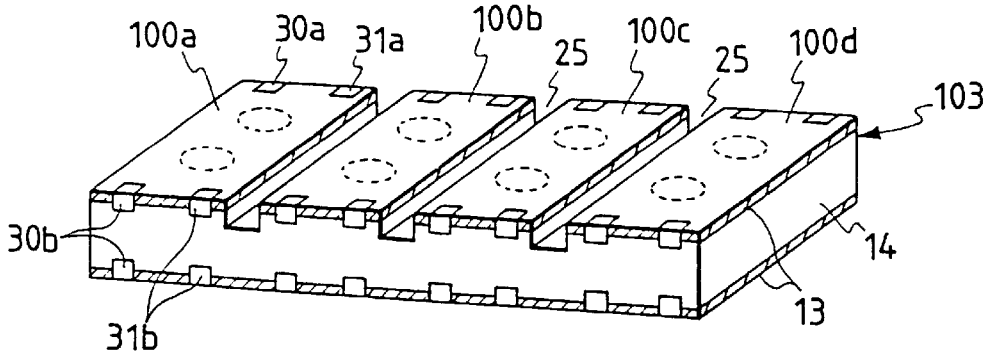
FIG. 10 is a perspective view showing an example of a multiple chip type common mode choke coil, which constitutes a third embodiment of the invention.

Another example of the chip type common mode choke coil, namely, a multiple chip type common mode choke coil, which constitutes a third embodiment of the invention, will be described with reference to FIGS. 10 and 11.

In those figures, reference numeral 103 designates a laminate forming the chip type common mode choke coil. The structure of the laminate 103 is such that four common mode choke coil elements 100*a*, 100*b*, 100*c* and 100*d* are arranged side by side which are equal in structure to the laminate 100 of the above-described first embodiment. Three grooves 25 are cut in the upper surface of the laminate 103 until they reach the non-magnetic member 14, to divide the magnetic layer 13 into four parts in correspondence to the four elements 100*a*, 100*b*, 100*c* and 100*d*.

Thereafter, the primary coil's external electrodes 30*a* and 30*b* and the secondary coil's external electrodes 31*a* and 31*b* are connected to the elements of the laminate 103 at predetermined positions. Thus, the desire multiple chip type common mode choke coil has been formed as shown in FIG. 10.

Figure 11A:
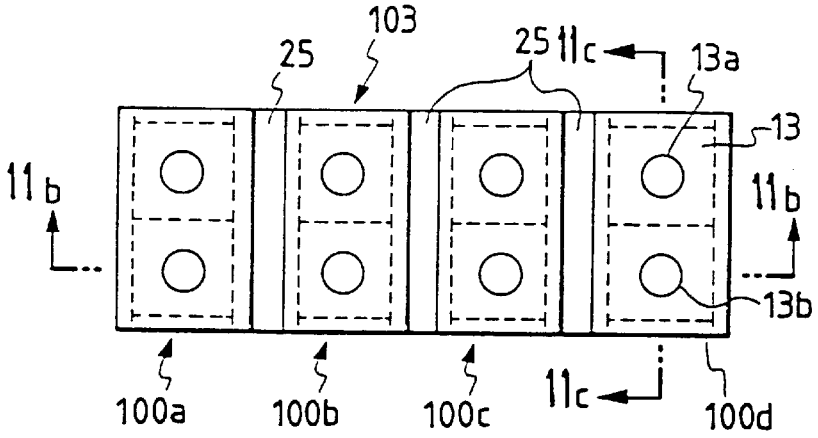
FIG. 11(*a*) is a plan view showing the multiple chip type common mode choke coil, FIG. 11(*b*) is a sectional view taken along line b—b in FIG. 11(*a*), and FIG. 11(*c*) is a sectional view taken along line c—c in FIG. 11(*a*).
Figure 11C:
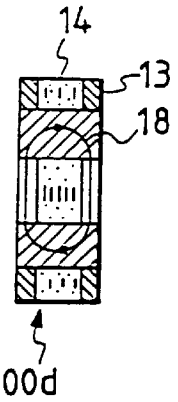
Figure 11B:
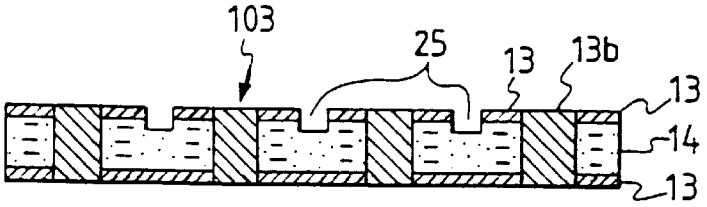

In the multiple chip type common mode choke coil, as shown in FIG. 11(*c*), in each of the elements 100*a* through 100*d* (FIG. 11(*c*) showing the element 100*d*) a closed magnetic path is formed, to provide a large magnetic flux output which completely crosses the primary and secondary coils. Hence, in the choke coil, the impedance is high, and the coupling coefficient of the primary coil and the secondary coil is large.

As was described above, in the multiple chip type common mode choke coil, the grooves 25 divide the magnetic member 13 into four parts respectively for the elements 100*a*, 100*b*, 100*c* and 100*d*. Hence, the elements are magnetically separated from one another, which prevents cross-talk between adjacent elements positively. In the embodiment, the upper magnetic layer 13 is divided by the grooves 25; however, the invention is not limited thereto or thereby. That is, it may be divided by many other methods. For instance, protrusions may be extended from the non-magnetic member 14 to divide the magnetic layer 13.

In the invention, in formation of the magnetic layers and the non-magnetic member, the materials may be relatively freely selected which can be fired at the same time; however, it is preferable to select a material relatively large in magnetic permeability for the magnetic members, and a material high in insulating resistance and low in dielectric constant for the non-magnetic member.

As was described above, in the chip type common mode choke coil of the invention, the non-magnetic sheets on which the conductor lines are formed are laminated one on another to provide the non-maanetic member, and the conductor lines are connected to form the primary and secondary coils inside the non-magnetic member, and the pair of magnetic layers are formed on the upper and lower surface of the non-magnetic member, and the magnetic cores are arranged substantially at the centers of the loops of the coils in such a manner that they penetrate the non-magnetic members and are connected to the pair of magnetic layers. Hence, the chip type common mode choke coil of the invention has the following effects or merits:

(1) The primary coil and the secondary coil, being covered by the non-magnetic substance, are completely separated from each other; that is, they are positively insulated from each other. Hence, the resultant choke coil is high in reliability. In addition, the conductor lines forming the primary coil, and those forming the secondary coil are also covered by the non-magnetic substance, and therefore the magnetic flux scarcely spreads between the coil electrodes, and accordingly the coupling coefficient of the primary coil and the secondary coil is large, and the normal mode impedance is low.

(2) Furthermore, in the choke coil of the invention, a close magnetic circuit is formed through the magnetic members, and therefore the common mode impedance is high.

(3) In the choke coil, stray capacitance can be reduced by employing a non-magnetic member small in dielectric constant. The resultant chip type common mode choke coil is excellent in high frequency characteristic.

(4) The lamination method may be applied to the manufacture of the chip type common mode choke coil. Hence, the chip type common mode choke coil of the invention may be manufactured on a large scale, and may be miniaturized: that is, it is high in productivity.

(5) In the multiple chip type common mode choke coil, at least one of the magnetic layers is divided into parts in correspondence to the common mode choke coil elements, which positively eliminates cross-talk between adjacent common mode choke coil elements.

(6) In the method according to the invention, the core arranging holes are formed in the laminate substantially at the centers of the loops of the coils, and the magnetic paste is filled into the core arranging holes. Hence, the magnetic cores can be arranged at predetermined positions readily and positively.

(7) Furthermore, the magnetic member having a predetermined thickness is placed on the laminate to provide an assembly of the laminate and tile magnetic member, and the assembly is punched with the puncher which operates with a predetermined stroke, so that, substantially at the centers of the loops of the coils, the core arranging holes are formed in the laminate while the magnetic pieces are blanked from said magnetic member and are press-fitted in the core arranging holes. That is, the formation of the core arranging holes and the press-fitting of the magnetic cores are achieved at the same time, which contributes to the improvement in productivity of the chip type common mode choke coil.

While there has been described in connection with the preferred embodiment of this invention, it will be obvious to those skilled in the art that various changes and modifications may be made therein without departing from the invention particularly with respect to the patterns of the primary and secondary coils, the number of magnetic or non-magnetic sheets to be laminated and the configuration of the core arranging holes, and it is intened, therefore, to cover in the appended claims all such changes and modifications as fall within the true spirit and scope of the invention.

What is claimed is:

1. A method for manufacturing a chip type common mode choke coil, said method comprising the steps of:

(a) forming a stack of green sheets including:

(1) a lamination including a plurality of non-magnetic sheets each having conductive lines printed thereon, said conductive lines being coupled together and having a shape which will form primary and secondary coils having respective center loops; and (2) first and second magnetic layers located on a top and a bottom surface of said lamination, respectively, and extending over said center loops;

(b) forming core receiving holes through both said lamination and said magnetic layers in the area of said center loops after said stack has been formed; and (c) inserting magnetic material into said core receiving holes.

2. A method according to claim 1, wherein said forming step creates said core receiving holes simultaneously.

3. A method according to claim 1, wherein said forming step forms each respective core receiving hole in a single operation.

4. A method according to claim 1, wherein said inserting step comprises the step of inserting magnetic paste into said core receiving holes.

5. A method according to claim 4, wherein said magnetic paste is inserted into said core receiving holes using a squeegee method.

6. A method according to claim 4, wherein said step of inserting magnetic paste into said core receiving holes is carried out while a partial vacuum is applied to said core receiving holes.

7. A method according to claim 1, wherein each of said non-magnetic sheets is generally planar in shape and is aligned parallel to the other said non-magnetic sheets.

8. A method according to claim 7, wherein said core receiving holes are formed along respective axes which lie perpendicular to said planes of said non-magnetic sheets.

9. A method according to claim 8, wherein said magnetic layers are respective laminates, each including a plurality of magnetic sheets, each of said magnetic sheets being generally planar in shape and being aligned parallel to said non-magnetic sheets.

10. A method according to claim 1, wherein said magnetic layers are respective laminates, each including a plurality of magnetic sheets.

11. A method according to claim 1, wherein said inserting step is carried out after said forming step is completed.

12. A method according to claim 1, wherein said inserting step is carried out substantially simultaneously with said forming step.

13. A method according to claim 12, wherein said inserting step comprises the step of inserting respective plugs of magnetic material into said core receiving holes as said core receiving holes are being formed.

14. A method according to claim 1, wherein said inserting step comprises the steps of:

placing a magnetic member on top of said first magnetic layer in the area of said center loops; and using a punch to cut into both said magnetic member and said stack of green sheets to substantially simultaneously form said core receiving holes and place said magnetic material into said core receiving holes.

15. A method for manufacturing a chip type common mode choke coil, said method comprising the steps of:

(a) forming a stack of green sheets including:

(1) a lamination including a plurality of non-magnetic sheets each having conductive lines printed thereon, said conductive lines being coupled together and having a shape which will form primary and secondary coils having respective center loops; and (2) first and second magnetic layers located on a top and a bottom surface of said lamination, respectively, and extending over said center loops;

(b) placing a magnetic member on the top of said first magnetic layer and extending over the area of said center loops to form an assembly including said stack of green sheets and said magnetic member; and (c) using a punch assembly to substantially simultaneously:

(1) form core receiving holes through said assembly in the area of said center loops; and (2) insert magnetic material from said magnetic member into said core receiving holes.

16. A method according to claim 15, wherein said punch assembly includes a pair of punches, each punch being used to form a respective core receiving hole.

17. A method according to claim 15, wherein each of said non-magnetic sheets is generally planar in shape and is aligned parallel to the other said non-magnetic sheets.

18. A method according to claim 17, wherein said core receiving holes are formed along respective axes which lie perpendicular to said planes of said non-magnetic sheets.

19. A method according to claim 18, wherein said magnetic layers are respective laminates, each including a plurality of magnetic sheets, each of said magnetic sheets being generally planar in shape and being aligned parallel to said non-magnetic sheets.

20. A method according to claim 15, wherein said magnetic layers are respective laminates, each including a plurality of magnetic sheets.

* * * * *